US011389742B2

(12) United States Patent
Gao et al.

(10) Patent No.: US 11,389,742 B2
(45) Date of Patent: Jul. 19, 2022

(54) INTERACTIVE TOY

(71) Applicant: SHANGHAI BLOCKS TECHNOLOGY GROUP CO., LTD., Shanghai (CN)

(72) Inventors: Chao Gao, Shanghai (CN); Yi He, Shanghai (CN); Liang Li, Shanghai (CN); Zhenyu Wan, Shanghai (CN); Lei Li, Shanghai (CN)

(73) Assignee: SHANGHAI BLOCKS TECHNOLOGY GROUP CO., LTD., Shanghai (CN)

( * ) Notice: Subject to any disclaimer, the term of this patent is extended or adjusted under 35 U.S.C. 154(b) by 0 days.

(21) Appl. No.: 17/263,087

(22) PCT Filed: Jun. 11, 2019

(86) PCT No.: PCT/CN2019/090609
§ 371 (c)(1),
(2) Date: Jan. 25, 2021

(87) PCT Pub. No.: WO2020/019886
PCT Pub. Date: Jan. 30, 2020

(65) Prior Publication Data

US 2021/0308595 A1 Oct. 7, 2021

(30) Foreign Application Priority Data

Jul. 25, 2018 (CN) ..... 201810829981.9

(51) Int. Cl.
*A63H 30/00* (2006.01)
*A63H 33/04* (2006.01)
(Continued)

(52) U.S. Cl.
CPC ..... *A63H 33/042* (2013.01); *A63H 33/086* (2013.01); *A63H 33/26* (2013.01); *A63H 2200/00* (2013.01)

(58) Field of Classification Search
CPC ..... A63H 33/04–14
See application file for complete search history.

(56) References Cited

U.S. PATENT DOCUMENTS 3,737,749 A * 6/1973 Schmit ..... H02P 23/24 318/472
3,775,648 A * 11/1973 Brown ..... H02P 6/20 318/400.05

(Continued)

FOREIGN PATENT DOCUMENTS

CN 2390659 Y 8/2000
CN 104238803 A 12/2014

(Continued)

*Primary Examiner* — Eugene L Kim
*Assistant Examiner* — Matthew B Stanczak
(74) *Attorney, Agent, or Firm* — Baayramoglu Law Offices LLC

(57) ABSTRACT

An interactive toy includes a housing, a control module, a motor, a rotating shaft, and an external member. The rotating shaft is exposed outside the housing, and is connected to the external member. The control module is configured to control the motor to drive the rotating shaft to rotate. The toy further includes a measurement module and an analysis module. The measurement module is configured to measure an angle by which the rotating shaft rotates from an initial stationary state to the state in which its rotating speed reaches the maximum. The analysis module is configured to compare a preset reference angle with the angle by which the rotating shaft from the initial stationary state to the state in which the rotating speed of the rotating shaft reaches the maximum to determine whether the external member encounters an obstacle.

17 Claims, 3 Drawing Sheets

(51) Int. Cl.
*A63H 33/08* (2006.01)
*A63H 33/26* (2006.01)

(56) References Cited

U.S. PATENT DOCUMENTS 4,221,997 A * 9/1980 Flemming ..... B25J 9/046 318/568.13
4,473,786 A * 9/1984 Miyashita ..... G05B 19/416 318/561
4,559,524 A * 12/1985 Suzuki ..... G01D 5/34715 250/231.16
5,239,490 A * 8/1993 Masaki ..... G01B 7/30 702/41
2003/0143920 A1* 7/2003 Greenberg ..... A63H 33/00 446/408
2004/0077257 A1* 4/2004 Mimlitch, III ..... A63H 33/12 446/85
2006/0252340 A1* 11/2006 Bach ..... A63H 33/042 446/124
2008/0220689 A1* 9/2008 Mimlitch ..... A63H 33/108 446/91
2009/0305602 A1* 12/2009 Gaute ..... A63H 33/042 446/91
2010/0311300 A1* 12/2010 Hansen ..... A63H 33/042 446/91
2011/0151743 A1* 6/2011 Munch ..... A63H 33/086 446/91
2011/0159776 A1* 6/2011 Mak ..... G05D 1/0858 446/232
2011/0202308 A1* 8/2011 Kishida ..... G01D 5/2449 702/151
2013/0217294 A1* 8/2013 Karunaratne ..... A63H 33/042 446/90
2013/0217295 A1* 8/2013 Karunaratne ..... A63H 27/001 446/124
2014/0300903 A1* 10/2014 Shimizu ..... G01D 5/30 356/498
2016/0361662 A1* 12/2016 Karunaratne ..... G06F 3/041
2017/0030745 A1* 2/2017 Kimura ..... G01D 5/38
2017/0144083 A1* 5/2017 K Rsgaard ..... A63H 33/086
2017/0221383 A1* 8/2017 Karol ..... H02K 5/00
2018/0059681 A1* 3/2018 Kuhara ..... A47L 9/2889
2018/0138847 A1* 5/2018 Kaidu ..... H02P 3/025
2019/0042530 A1* 2/2019 Wang ..... G06F 15/7803
2019/0137959 A1* 5/2019 Kim ..... G05B 11/01
2019/0299113 A1* 10/2019 Lee ..... A63H 33/086
2020/0078942 A1* 3/2020 Nakashima ..... B25J 9/1664
2020/0378080 A1* 12/2020 Ostrow ..... B25J 9/162
2021/0107147 A1* 4/2021 Xu ..... B25J 9/163
2021/0190177 A1* 6/2021 Su ..... F16H 1/22
2021/0197096 A1* 7/2021 Donaldson ..... A63H 33/086
2021/0297018 A1* 9/2021 Omata ..... G01D 5/24
2021/0325213 A1* 10/2021 Wang ..... B61D 15/12
2021/0333082 A1* 10/2021 Bai ..... G05B 19/416

FOREIGN PATENT DOCUMENTS

CN 204428835 U 7/2015
CN 206463509 U 9/2017
CN 107243160 A 10/2017
CN 207055972 U 3/2018
CN 107899255 A 4/2018
CN 108014504 A 5/2018
CN 207412718 U 5/2018
CN 109011651 A 12/2018
JP 2009039419 A 2/2009
WO 2007056239 A3 10/2007

* cited by examiner

INTERACTIVE TOY

CROSS REFERENCE TO THE RELATED APPLICATIONS

This application is the national phase entry of International Application No. PCT/CN2019/090609, filed on Jun. 11, 2019, which is based upon and claims priority to Chinese Patent Application No. 201810829981.9, filed on Jul. 25, 2018, the entire contents of which are incorporated herein by reference.

TECHNICAL FIELD

The present invention relates to an interactive toy, and more particularly, to a novel interactive toy that enhances interactive fun.

BACKGROUND

Interactive toys refer to toys that react to users' actions, such as the users' sounds and movements. Interactive toys can better meet users' behavior patterns and needs through intelligent technology of sound production, motion sensing and interaction, while focusing on users' behavior and experience to enhance the interactivity and entertainment.

As the artificial intelligence and multimedia technology are increasingly integrated into people's daily life, interactive toys are emerging to gradually replace some traditional toys in order to meet users' increasing behavioral needs. For example, interactive toys play an extremely important role in the growth of children. Interactive toys use abstract images and brief performances to lead children to cognize things and cultivate their abilities, and promote the development of their thinking and various abilities by combining learning with entertaining activities. Parents and children use interactive toys to enhance the children's trust and security with respect to adults and the world and cultivate parent-child intimacy. Adults can relax from the stressful work and life environment by means of interactive toys to improve their work and life states.

It is, therefore, highly desirable to provide a novel interactive toy that can enhance interactive fun and improve users' experience.

SUMMARY

The problem to be solved by the present invention is to provide an interactive toy, through which the user's reaction sensitivity can be trained.

In order to solve the above-mentioned problems, the present invention provides an interactive toy, including a housing, a control module, a motor, a rotating shaft, and an external member. The housing is electrically connected to the external member, and a control module is arranged inside the housing. The control module is configured to control the motor to drive the rotating shaft to rotate. The rotating shaft is exposed outside the housing and is connected to the external member. The toy further includes a measurement module and an analysis module. The measurement module is connected to one end of the rotating shaft exposed outside the housing and is configured to measure an angle by which the rotating shaft rotates from an initial stationary state to the state in which its rotating speed reaches the maximum. The analysis module is connected to the control module and is configured to compare a preset reference angle with the angle by which the rotating shaft rotates from the initial stationary state to the state in which its rotating speed reaches the maximum to determine whether the external member encounters an obstacle.

Further, the analysis module compares the preset reference angle with the angle by which the rotating shaft rotates from the initial stationary state to the state in which its rotating speed reaches the maximum. When the angle by which the rotating shaft rotates from the initial stationary state to the state in which its rotating speed reaches the maximum is less than the preset reference angle, the analysis module determines that the external member encounters the obstacle. When the angle by which the rotating shaft rotates from the initial stationary state to the state in which its rotating speed reaches the maximum is greater than or equal to the preset reference angle, the analysis module determines that the external member does not encounter the obstacle.

Further, the toy further includes an external sensing module, and the external sensing module is connected to the control module. The external sensing module sends an instruction to the control module after detecting the obstacle exists, and the control module starts the motor to drive the rotating shaft to rotate after a random time has elapsed according to the instruction.

Further, the external sensing module includes an ultrasonic sensor or a position sensor.

Further, the toy further includes a signal receiving module, and the signal receiving module is connected to the control module. The control module starts the motor to drive the rotating shaft to rotate according to the instruction received by the signal receiving module.

Further, the toy further includes a sound module, and the sound module is configured to emit or change a sound when the control module starts the motor to drive the rotating shaft to rotate.

Further, the toy further includes a display device, and the display device is connected to the analysis module. The display device is configured to display the number of times the external member encounters the obstacle and/or the number of times the external member does not encounter the obstacle.

Further, the display device includes a displayer, a mobile phone or a tablet computer.

Further, the measurement module includes a photoelectric encoder read head and an encoder grating disk. The encoder grating disk is fixed on the rotating shaft, and is configured to follow the rotating shaft to rotate.

Further, when the toy is started, the control module controls the motor to drive the rotating shaft to reversely rotate a preset angle.

Further, the toy further includes a stop module, and a position of the rotating shaft in the initial stationary state is set by driving the rotating shaft to rotate reversely through the control module to enable the external member to be stopped by the stop module.

By implementing the interactive toy of the present invention described above, the present invention has the following advantages.

(1) The toy of the present invention uses human-computer interaction to enable users to relax during the game.

(2) The toy of the present invention is user-friendly, integrates sound and picture, and has strong functionality.

(3) The toy of the present invention combines learning with entertaining activities, thereby improving parent-child intimacy.

BRIEF DESCRIPTION OF THE DRAWINGS

Hereinafter, the concept, specific structure and technical effects of the present invention will be further described with reference to the drawings to fully understand the objective, features and advantages of the present invention.

In the figures: 1, housing; 10, circuit board; 11, control module; 12, analysis module; 13, signal receiving module; 2, external member; 20, upper jaw; 21, lower jaw; 22, stop module; 3, external sensing module; 4, display device; 5, rotating shaft; 6, measurement module; 61, photoelectric encoder read head; 62, encoder grating disk; 7, motor; and 8, sound module.

DETAILED DESCRIPTION OF THE EMBODIMENTS

The technical solutions in the embodiments of the present invention will be clearly and completely described below in conjunction with the embodiments of the present invention. Obviously, the described embodiments are only a part of the embodiments of the present invention, rather than all the embodiments. Based on the embodiments of the present invention, all other embodiments obtained by those having ordinary skill in the art without creative efforts shall fall within the scope of protection of the present invention.

Embodiment 1

Figure 1:
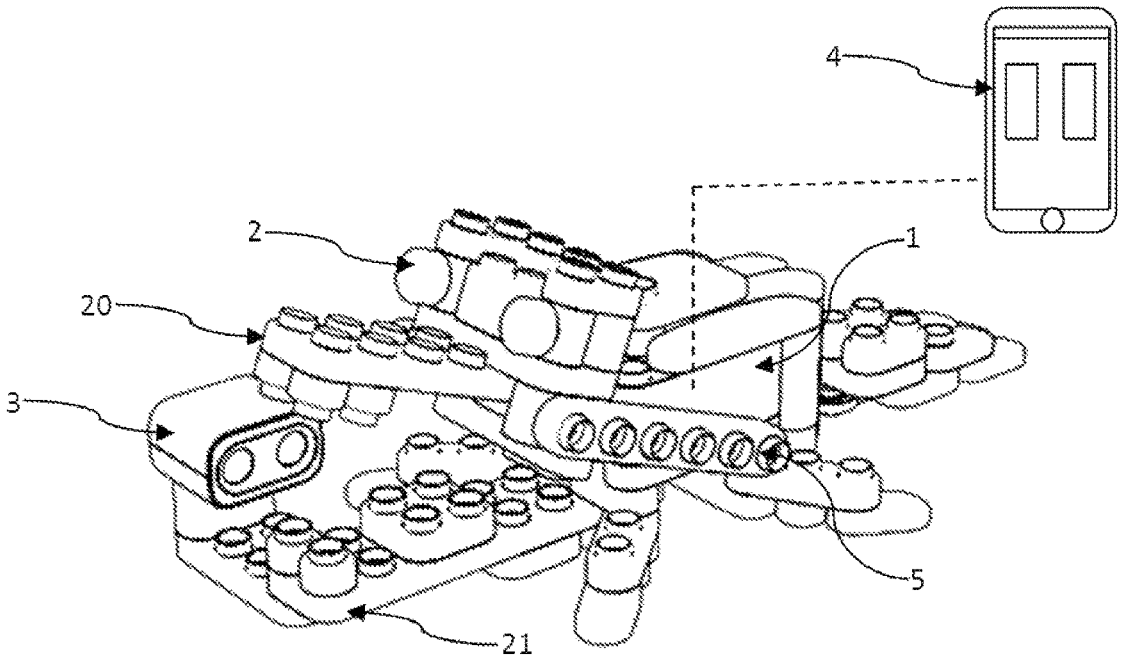
FIG. 1 is a schematic view of the structure of an interactive toy according to an embodiment of the present invention.
Figure 2:
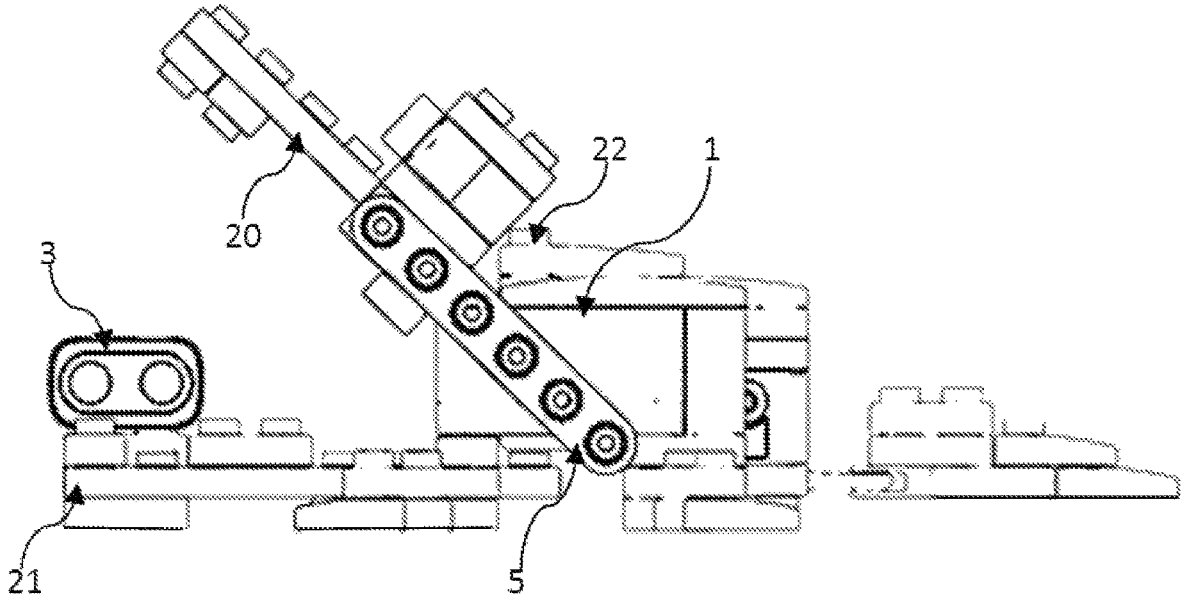
FIG. 2 is a side view of the structure of the interactive toy according to the embodiment of the present invention.
Figure 3:
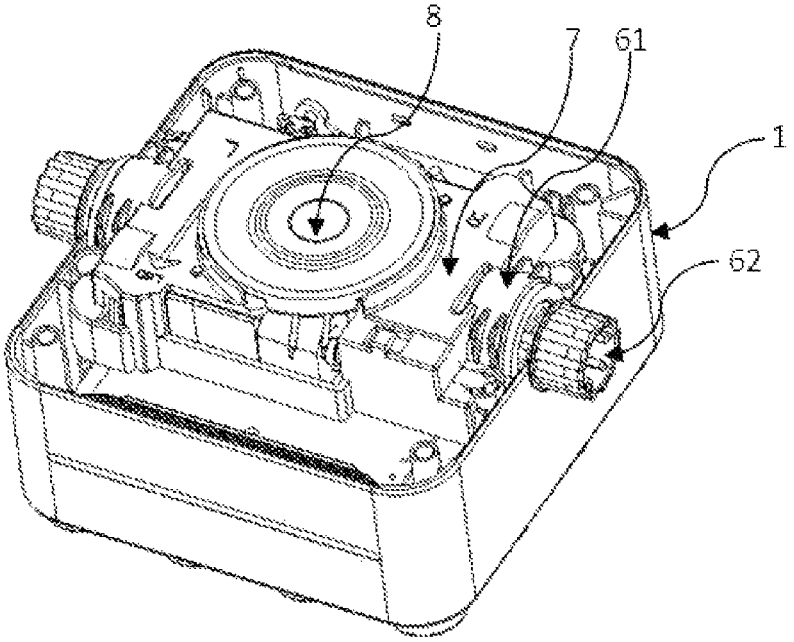
FIG. 3 is a schematic view of the structure inside the housing of the interactive toy according to the embodiment of the present invention.
Figure 4:
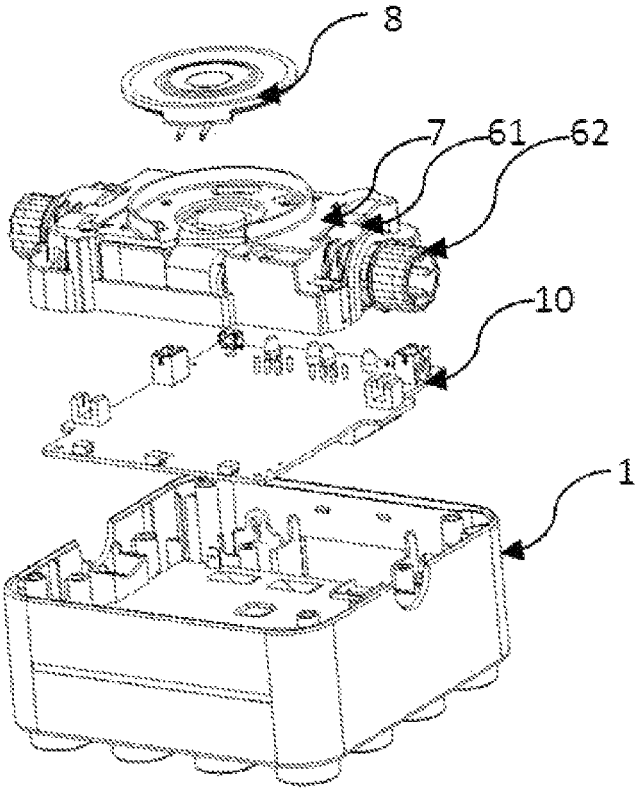
FIG. 4 is an exploded view of the structure inside the housing of the interactive toy according to the embodiment of the present invention.
Figure 5:
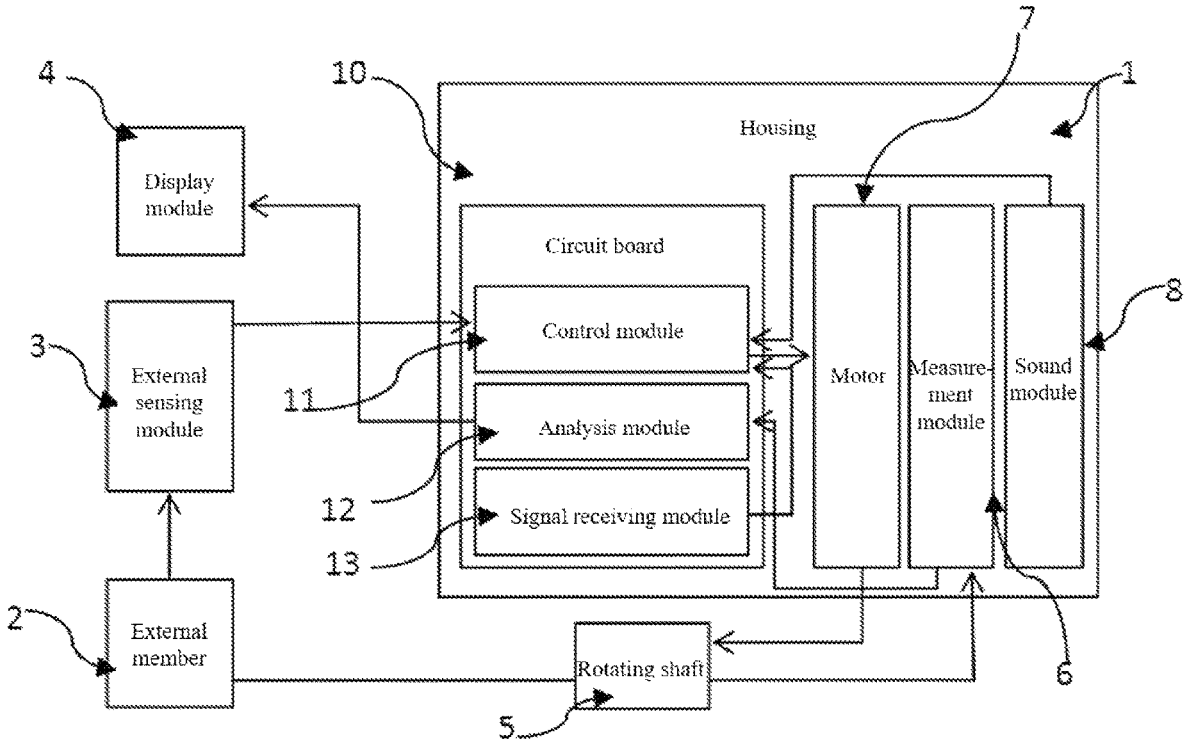
FIG. 5 is a structural block diagram of the interactive toy according to the embodiment of the present invention.

As shown in FIGS. 1-4, an interactive toy with the shape of a crocodile includes the housing 1, the external member 2, the external sensing module 3, the motor 7, the rotating shaft 5, the measurement module 6, the control module 11, and the analysis module 12. The housing 1 is electrically connected to the external member 2, and a circuit board is arranged inside the housing 1. The control module 11 is arranged on the circuit board inside the housing 1. The rotating shaft 5 is exposed outside the housing 1, and is connected to the external member 2. The control module 11 is electrically connected to the motor 7, and is configured to control the motor 7 to drive the rotating shaft 5 to rotate. The external sensing module 3 is configured to detect whether an obstacle is located in the external member 2. The external sensing module 3 is connected to the control module 11, and sends an instruction to the control module 11 after detecting the obstacle exists. After a random time has elapsed, the control module 11 starts the motor 7 to drive the rotating shaft 5 to rotate according to the instruction. The measurement module 6 is connected to one end of the rotating shaft 5 exposed outside the housing, and is configured to measure an angle by which the rotating shaft 5 rotates from an initial stationary state to the state in which its rotating speed reaches the maximum. The analysis module 12 is arranged on the circuit board inside the housing 1, and is configured to compare a preset reference angle with the angle by which the rotating shaft 5 rotates from the initial stationary state to the state in which its rotating speed reaches the maximum to determine whether the external member 2 encounters the obstacle.

Further, the analysis module 12 compares the preset reference angle with the angle by which the rotating shaft 5 rotates from the initial stationary state to the state in which its rotating speed reaches the maximum. When the angle by which the rotating shaft 5 rotates from the initial stationary state to the state in which its rotating speed reaches the maximum is less than the preset reference angle, the analysis module 12 determines that the external member 2 shaped as a crocodile encounters the obstacle. When the angle by which the rotating shaft 5 rotates from the initial stationary state to the state in which its rotating speed reaches the maximum is greater than or equal to the preset reference angle, the analysis module 12 determines that the external member 2 does not encounter the obstacle.

Further, the external sensing module 3 includes an ultrasonic sensor or a position sensor.

Further, the toy further includes the sound module 8. The sound module 8 is arranged on the housing 1, and is electrically connected to the control module 11. The sound module 8 is configured to emit or change a sound when the control module 11 starts the motor 7 to drive the rotating shaft 5 to rotate.

Further, the toy further includes the display device 4, and the display device 4 is connected to the analysis module 12. The display device 4 is configured to display the number of times the external member 2 encounters the obstacle and/or the number of times the external member 2 does not encounter the obstacle.

Further, the display device 4 includes a displayer, a mobile phone or a tablet computer.

Further, the measurement module 6 includes the photoelectric encoder read head 61 and the encoder grating disk 62. The encoder grating disk 62 is fixed on the rotating shaft 5, and is configured to follow the rotating shaft 5 to rotate, so as to obtain the angle by which the rotating shaft 5 rotates from the initial stationary state to the state in which its rotating speed reaches the maximum.

Further, when the toy is started, the control module 11 controls the motor 7 to drive the rotating shaft 5 to reversely rotate a preset angle.

Further, the toy further includes the stop module 22, and the stop module 22 is arranged on the external member 2. A position of the rotating shaft 5 in the initial stationary state is set by driving the rotating shaft 5 to rotate reversely through the control module 11 to enable the external member 2 to be stopped by the stop module 22. In other words, the stop module 22 stops the reverse rotation of the upper jaw 20 when the upper jaw 20 and the lower jaw 21 of the external member 2 shaped as a crocodile are opened, so as to obtain the position of the rotating shaft 5 in the initial stationary state. In the present embodiment, the stop module 22 is a building block. Different structures or different building positions of the building block of the stop module 22 produce different position settings of the initial stationary state, that is, the position setting of the initial stationary state can be adjusted by adjusting the position of the stop module 22.

Taking the interactive toy with the external member 2 shaped as a crocodile as an example, a single-player game is performed, including the following steps:

S1: at the beginning of the game, the upper jaw 20 and the lower jaw 21 of the external member 2 shaped as a crocodile are automatically opened to the stop position of the stop module 22.

S2: it is determined whether a foreign body is put between the upper jaw 20 and the lower jaw 21 by the ultrasonic sensor.

S3: when the foreign body is detected in the mouth, the ultrasonic sensor transmits a signal to the control module 11, the control module 11 controls the motor 7 to drive the rotating shaft 5 to rotate, and the upper jaw 20 and the lower jaw 21 emit a sound of biting within a random time and are closed at the same time.

S4: the code disk data of the photoelectric encoder are obtained, and the analysis module 12 determines whether the user is bitten.

S4i: if the user does not touch the upper jaw 20 or the lower jaw 21 during the fall of the upper jaw 20, it is determined that the user successfully escaped, and the display device 4 displays the user scores one point.

S4ii: if the user touches the upper jaw 20 or the lower jaw 21 during the fall of the upper jaw 20, it is determined that the user is bitten by the external member 2 shaped as a crocodile, and the display device 4 displays the toy scores one point.

S5: the game is limited to 2 minutes, and the player with the highest score will win.

Embodiment 2

As shown in FIGS. 1-4, an interactive toy with the shape of a crocodile includes the housing 1, the external member 2, the external sensing module 3, the motor 7, the rotating shaft 5, the measurement module 6, the control module 11, and the analysis module 12. The housing 1 is electrically connected to the external member 2, and a circuit board is arranged inside the housing 1. The control module 11 is arranged on the circuit board inside the housing 1. The rotating shaft 5 is exposed outside the housing 1, and is connected to the external member 2. The control module 11 is electrically connected to the motor 7, and is configured to control the motor 7 to drive the rotating shaft 5 to rotate. The external sensing module 3 is configured to detect whether an obstacle is located in the external member 2. The external sensing module 3 is connected to the control module 11, and sends an instruction to the control module 11 after detecting the obstacle exists. After a random time has elapsed, the control module 11 starts the motor 7 to drive the rotating shaft 5 to rotate according to the instruction. The measurement module 6 is connected to one end of the rotating shaft 5 exposed outside the housing, and is configured to measure an angle by which the rotating shaft 5 rotates from an initial stationary state to the state in which its rotating speed reaches the maximum. The analysis module 12 is arranged on the circuit board inside the housing 1, and is configured to compare a preset reference angle with the angle by which the rotating shaft 5 rotates from the initial stationary state to the state in which its rotating speed reaches the maximum to determine whether the external member 2 encounters the obstacle.

Further, the analysis module 12 compares the preset reference angle with the angle by which the rotating shaft 5 rotates from the initial stationary state to the state in which its rotating speed reaches the maximum. When the angle by which the rotating shaft 5 rotates from the initial stationary state to the state in which its rotating speed reaches the maximum is less than the preset reference angle, the analysis module 12 determines that the external member 2 shaped as a crocodile encounters the obstacle. When the angle by which the rotating shaft 5 rotates from the initial stationary state to the state in which its rotating speed reaches the maximum is greater than or equal to the preset reference angle, the analysis module 12 determines that the external member 2 does not encounter the obstacle.

Further, the external sensing module 3 includes an ultrasonic sensor or a position sensor.

Further, the toy further includes the signal receiving module 13. The signal receiving module 13 is arranged on the circuit board and is connected to the control module 11. The control module 11 starts the motor 7 to drive the rotating shaft 5 to rotate according to the instruction received by the signal receiving module 13.

Further, the toy further includes the sound module 8. The sound module 8 is arranged on the housing 1, and is electrically connected to the control module 11. The sound module 8 is configured to emit or change a sound when the control module 11 starts the motor 7 to drive the rotating shaft 5 to rotate.

Further, the toy further includes the display device 4, and the display device 4 is connected to the analysis module 12. The display device 4 is configured to display the number of times the external member 2 encounters the obstacle and/or the number of times the external member 2 does not encounter the obstacle.

Further, the display device 4 includes a displayer, a mobile phone or a tablet computer.

Further, the measurement module 6 includes the photoelectric encoder read head 61 and the encoder grating disk 62. The encoder grating disk 62 is fixed on the rotating shaft 5, and is configured to follow the rotating shaft 5 to rotate, so as to obtain the angle by which the rotating shaft 5 rotates from the initial stationary state to the state in which its rotating speed reaches the maximum.

Further, when the toy is started, the control module 11 controls the motor 7 to drive the rotating shaft 5 to reversely rotate a preset angle.

Further, the toy further includes the stop module 22, and the stop module 22 is arranged on the external member 2. A position of the rotating shaft 5 in the initial stationary state is set by driving the rotating shaft 5 to rotate reversely through the control module 11 to enable the external member 2 to be stopped by the stop module 22. In other words, the stop module 22 stops the reverse rotation of the upper jaw 20 when the upper jaw 20 and the lower jaw 21 of the external member 2 shaped as a crocodile are opened, so as to obtain the position of the rotating shaft 5 in the initial stationary state. In the present embodiment, the stop module 22 is a building block. Different structures or different building positions of the building block of the stop module 22 produce different position settings of the initial stationary state, that is, the position setting of the initial stationary state can be adjusted by adjusting the position of the stop module 22.

Taking the interactive toy with the external member 2 shaped as a crocodile as an example, a two-player game is performed. User A shakes the mobile phone to control the upper jaw 20 and the lower jaw 21 of the external member 2 shaped as a crocodile to be closed, while user B first puts his/her hand between the upper jaw 20 and the lower jaw 21 and then escapes when the upper jaw 20 is about to fall. The specific steps are as follows:

S1: at the beginning of the game, the upper jaw 20 and the lower jaw 21 of the external member 2 shaped as a crocodile are automatically opened to the stop position of the stop module 22.

S2: it is determined whether the user B puts his/her hand between the upper jaw 20 and the lower jaw 21 by the ultrasonic sensor.

S3: the user A shakes the mobile phone to send an instruction, the signal receiving module 13 receives the instruction and then transmits the instruction to the control module 11, so that the control module 11 controls the motor 7 to drive the rotating shaft 5 to rotate, and the upper jaw 20 and the lower jaw 21 emit a sound of biting within a random time and are closed at the same time.

S4: the code disk data of the photoelectric encoder are obtained, and the analysis module 12 determines whether the user is bitten.

S4i: if the user B does not touch the upper jaw 20 or the lower jaw 21 during the fall of the upper jaw 20, it is determined that the user B successfully escaped, and the display device 4 displays the user B scores one point.

S4ii: if the user B touches the upper jaw 20 or the lower jaw 21 during the fall of the upper jaw 20, it is determined that the user is bitten by the external member 2 shaped as a crocodile, and the display device 4 displays the user A scores one point.

S5: the game is limited to 2 minutes, and the player with the highest score will win.

The preferred embodiments of the present invention are described in detail above. It should be understood that those having ordinary skill in the art can make many modifications and changes according to the concept of the present invention without creative efforts. Therefore, all technical solutions that can be obtained by those skilled in the art through logical analysis, reasoning or limited experiments based on the concept of the present invention on the basis of the prior art shall fall within the scope of protection defined by the claims.

What is claimed is:

1. An interactive toy, comprising a housing, a control module, a motor, a rotating shaft, an external member, a measurement module and an analysis module;

wherein the rotating shaft is exposed outside the housing, and the rotating shaft is connected to the external member;

the control module is configured to control the motor to drive the rotating shaft to rotate;

the measurement module is configured to measure an angle, wherein the rotating shaft rotates by the angle from an initial stationary state to a state when a rotating speed of the rotating shaft reaches a maximum;

the analysis module is configured to compare a preset reference angle with the angle to determine whether the external member encounters an obstacle;

an external sensing module, wherein the external sensing module sends an instruction to the control module after detecting the obstacle exists, and the control module starts the motor to drive the rotating shaft to rotate after a random time has elapsed according to the instruction;

a stop module; wherein a position of the rotating shaft in the initial stationary state is set by driving the rotating shaft to rotate reversely through the control module to enable the external member to be stopped by the stop module; and wherein the stop module is arranged on the external member.

2. The interactive toy according to claim 1, wherein the analysis module compares the preset reference angle with the angle, wherein the rotating shaft rotates by the angle from the initial stationary state to the state when the rotating speed of the rotating shaft reaches the maximum;

when the angle is less than the preset reference angle, the analysis module determines that the external member encounters the obstacle; and when the angle is greater than or equal to the preset reference angle, the analysis module determines that the external member does not encounter the obstacle.

3. The interactive toy according to claim 2, further comprising a sound module, wherein the sound module is configured to emit or change a sound when the control module starts the motor to drive the rotating shaft to rotate.

4. The interactive toy according to claim 2, further comprising a display device, wherein the display device is configured to display a number of times the external member encounters the obstacle and/or a number of times the external member does not encounter the obstacle.

5. The interactive toy according to claim 2, wherein the measurement module comprises a photoelectric encoder read head and an encoder grating disk; wherein the encoder grating disk is fixed on the rotating shaft and the encoder grating disk is configured to follow the rotating shaft to rotate.

6. The interactive toy according to claim 1, wherein the external sensing module comprises an ultrasonic sensor or a position sensor.

7. The interactive toy according to claim 6, further comprising a sound module, wherein the sound module is configured to emit or change a sound when the control module starts the motor to drive the rotating shaft to rotate.

8. The interactive toy according to claim 6, further comprising a display device, wherein the display device is configured to display a number of times the external member encounters the obstacle and/or a number of times the external member does not encounter the obstacle.

9. The interactive toy according to claim 1, further comprising a signal receiving module, wherein the control module starts the motor to drive the rotating shaft to rotate according to the instruction received by the signal receiving module.

10. The interactive toy according to claim 9, further comprising a sound module, wherein the sound module is configured to emit or change a sound when the control module starts the motor to drive the rotating shaft to rotate.

11. The interactive toy according to claim 9, further comprising a display device, wherein the display device is configured to display a number of times the external member encounters the obstacle and/or a number of times the external member does not encounter the obstacle.

12. The interactive toy according to claim 1, further comprising a sound module, wherein the sound module is configured to emit or change a sound when the control module starts the motor to drive the rotating shaft to rotate.

13. The interactive toy according to claim 1, further comprising a display device, wherein the display device is configured to display a number of times the external member encounters the obstacle and/or a number of times the external member does not encounter the obstacle.

14. The interactive toy according to claim 1, wherein the measurement module comprises a photoelectric encoder read head and an encoder grating disk; wherein the encoder grating disk is fixed on the rotating shaft and the encoder grating disk is configured to follow the rotating shaft to rotate.

15. The interactive toy according to claim 1, wherein when the interactive toy is started, the control module controls the motor to drive the rotating shaft to reversely rotate a preset angle.

16. The interactive toy according to claim 1, wherein a position setting of the initial stationary state can be adjusted by adjusting a position of the stop module.

17. The interactive toy according to claim 1, wherein the external member comprises an upper jaw and a lower jaw configured to open when the rotating shaft is reversely rotated.

* * * * *